US005208605A

United States Patent [19]

Drake

[11] Patent Number: 5,208,605

[45] Date of Patent: May 4, 1993

[54] MULTI-RESOLUTION ROOFSHOOTER PRINTHEADS

[75] Inventor: Donald J. Drake, Rochester, N.Y.

[73] Assignee: Xerox Corporation, Stamford, Conn.

[21] Appl. No.: 770,272

[22] Filed: Oct. 3, 1991

[51] Int. Cl.[5] ..... B41V 2/05; B41V 2/205

[52] U.S. Cl. ..... 346/1.1; 346/140 R; 400/121; 400/126

[58] Field of Search ..... 346/1.1, 140 R; 400/126, 121

[56] References Cited

U.S. PATENT DOCUMENTS

| | | | |
|---|---|---|---|
| 3,747,120 | 7/1973 | Stemme | 346/140 R X |
| 3,864,696 | 2/1975 | Fischbeck | 346/140 R |
| 4,189,734 | 2/1980 | Kyser | 346/140 R X |
| 4,302,761 | 11/1981 | Yamamoto | 346/75 |
| 4,521,814 | 6/1985 | Ono et al. . | |
| 4,550,323 | 10/1985 | Gamblin . | |
| 4,692,773 | 9/1987 | Saito et al. . | |
| 4,714,936 | 12/1987 | Helinski | 346/140 R |
| 4,746,935 | 5/1988 | Allen | 346/140 R |
| 4,789,425 | 12/1988 | Drake et al. | 346/140 R X |
| 4,835,551 | 5/1989 | Ng . | |
| 4,963,882 | 10/1990 | Hickman . | |
| 4,985,710 | 1/1991 | Drake et al. . | |
| 5,075,689 | 12/1991 | Hoisington | 346/140 R X |
| 5,146,236 | 9/1992 | Hirata | 346/1.1 |

FOREIGN PATENT DOCUMENTS

| | | |
|---|---|---|
| 133338 | 10/1979 | Japan . |
| 232877 | 12/1984 | Japan . |

*Primary Examiner*—Joseph W. Hartary
*Attorney, Agent, or Firm*—Oliff & Berridge

[57] ABSTRACT

A printhead for a thermal ink jet printer, preferably a roofshooter type printer, includes at least two arrays of linear spaced apart nozzles and heating elements, each array having a different resolution to produce printed pages at a draft print using a low resolution array, at a letter quality print using a high resolution array, or a combination of both arrays to provide enhanced grey scale reproduction. The high resolution array allows for accurate reproduction at a reduced throughput while the low resolution array allows for moderate reproduction at a higher throughput. Alternatively, the two arrays could be used simultaneously to provide a fast, broad, coarse stroke and a slower, fine detail stroke.

20 Claims, 5 Drawing Sheets

MULTI-RESOLUTION ROOFSHOOTER PRINTHEADS

BACKGROUND OF THE INVENTION

1. Field of the Invention

The present invention relates to a multi-resolution roofshooter printhead which comprises at least two arrays of printhead nozzles, each having a resolution (dot per inch or DPI) that differs from the other to provide the capability of printing draft or letter quality, or producing superior grey scale reproduction with a single printhead without complicated controls or electronics to change drop size.

2. Description of Related Art

There are two general configurations for thermal ink jet drop on demand printheads. In one configuration, droplets are propelled from nozzles in a direction parallel to the flow of ink in ink channels and parallel to the surface of bubble generating heating elements of the printhead, such as that disclosed in U.S. Pat. No. 4,601,777 to Hawkins et al. This is referred to as a "side shooter". The other type propels droplets from nozzles in a direction normal to the surface of the bubble generating heating elements, such as U.S. Pat. Nos. 4,789,425 and 4,985,710 to Drake et al (the disclosures of which are herein incorporated by reference). This is sometimes referred to as a "roofshooter".

In roofshooters, and in ink jets in general, it has been customary to provide a single array of nozzles for reproducing an image. The use of a single array is limited since the resolution is constant or requires complex circuitry to change or modify the resolution. Printers are known which provide more than one array of nozzles in a printhead, but these have been designed specifically for increasing printhead speed in reproduction. There are many needs for the ability to change resolution of a printer to provide quality reproduction of various information which may be text or graphics, black and white, grey scale or full color.

U.S. Pat. No. 4,835,551 to Ng discloses an optical recording apparatus having plural resolution recordings wherein text and graphics can be printed at two different resolutions. A control unit adjusts resolution depending on what type of image is present. This apparatus includes a plurality of recording elements (LED's) arranged in a row along the length of a printhead. Image information comprising text and characters not in an area determined to include pictorial information is reproduced at a resolution of $N \times M$ dots per square inch. Image information in an area including pictorial information is reproduced at a resolution of $N \times (L \times M)$ dots per square inch where L is a number greater than one. This apparatus utilizes only one row of printing elements and utilizes control means (circuitry) for providing the different resolutions of the one row of printing elements by adjusting the current which is applied to drivers associated with the LED's and LED on-time duration.

U.S. Pat. No. 4,521,814 to Ono et al. discloses a method and apparatus for simultaneously outputting a graphic signal and an alphanumeric signal by using an image reproducing system. This is done using a literal head and a graphic head which have a respective number and diameter of beam components which are laser beams exiting from the respective heads. This reference describes methods to synchronize the pitches of the two heads.

U.S Pat. No. 4,789,425 to Drake et al., assigned to Xerox Corporation, discloses a fabrication process for manufacturing a roofshooter printhead. The printhead utilizes a single ink supply and an array of nozzles. Alternatively, in another embodiment, two arrays are shown for each elongated fill hole, each being offset from the other and having its own ink channels and separate ink cavity. The double array can either double linear nozzle density when the arrays are offset or double printing speed when the arrays are aligned.

U.S. Pat. No. 4,963,882 to Hickman discloses printing of pixel locations by an ink jet printer using multiple nozzles for each pixel wherein a nozzle failure will have a limited impact on image resolution. A pixel may be printed using two nozzles to increase resolution. Additionally, two nozzles may be used to print color images.

U.S. Pat. No. 4,550,323 to Gamblin discloses an elongated fluid jet printing apparatus wherein enhanced printer resolution is attained by a lesser density of electrodes. Two electrodes drive a single nozzle. Alternatively, in another embodiment, a double array of nozzles having an electrode on each end is disclosed. This reference also is deficient for failing to teach or suggest the use of multiple arrays, each having a different resolution.

U.S. Pat. No. 4,692,773 to Saito et al. discloses an image forming method using image forming elements having different concentrations and pitches wherein a forming element is driven with a varying signal which varies the size of a dot produced by the element.

U.S. Pat. No. 4,985,710 to Drake et al., assigned to Xerox Corporation, discloses a roofshooter printhead. Each printhead has a single ink supply and an array of nozzles.

No suggestion or teaching is present which combines in a printer the use of plural arrays of printheads, each having a different resolution. None of the known existing printing systems combine the use of multiple arrays of linear printhead nozzles, each having a different resolution to provide a simple printhead construction which is capable of providing a draft quality print and a letter quality print having different resolutions without complicated circuitry to change droplet size.

Further, the prior art does not teach or suggest a printer which is capable of providing enhanced reproduction capabilities through the use of multiple arrays of printheads, each having a different resolution which can provide multiple modes of resolution and can be utilized together to provide certain grey scale reproductions.

OBJECTS AND SUMMARY OF THE INVENTION

It is an object of the present invention to provide a thermal ink jet drop on demand printer which includes at least two arrays of linear spaced apart nozzles, each array having a different resolution to produce printed pages at a draft print using the low resolution array, at a letter quality print using the high resolution array, or in a combination of both arrays to provide enhanced grey scale reproduction. Additionally, the dual array provides redundancy in the case that a jet is clogged.

To achieve the foregoing and other objects, and to overcome the deficiencies of the prior art, the present invention provides a thermal ink jet printhead, preferably a roofshooter type printhead, which comprises two parallel arrays of nozzles. Each array of nozzles and heater transducers is sized to provide a different resolution of drop size of ink onto a medium to allow a fine (high) resolution and a course (low) resolution to be obtainable from the same printhead. The arrays may be used individually to provide a required resolution or may be used in conjunction with one another to provide an alternative resolution for use in grey scale reproduction. A first array may comprise small nozzles and heater transducers which provide a fine, high resolution reproduction and the second array may comprise larger nozzles which provide a course, low resolution reproduction. The high resolution array allows for accurate reproduction at a reduced throughput while the low resolution array allows for moderate reproduction at a higher throughput. Alternatively, the two arrays could be used simultaneously to provide a fast, broad, course stroke and a slower, fine detail stroke. The low resolution array could be selected for draft printing, while the high resolution could be selected for letter quality printing and graphics.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
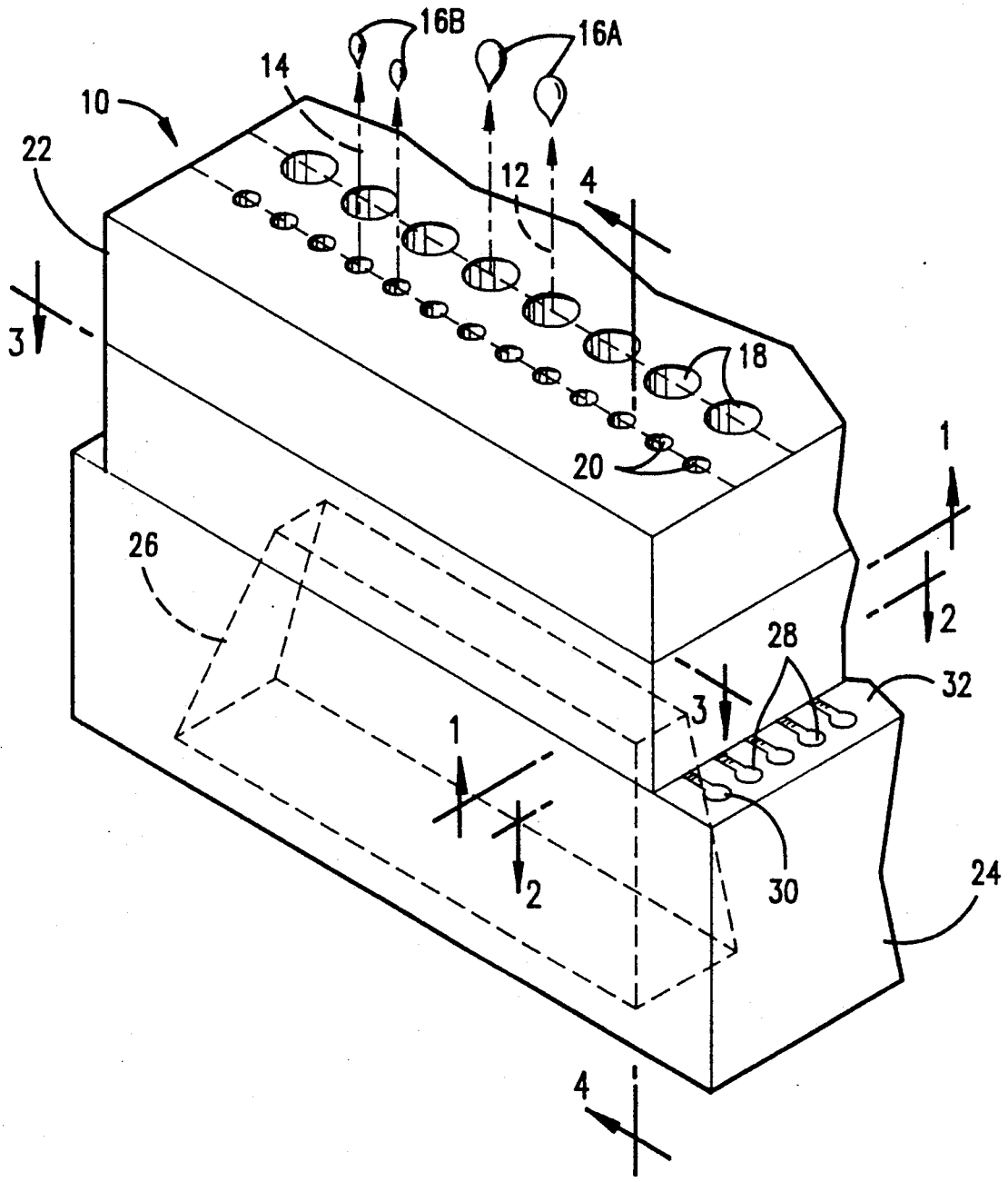
FIG. 1 is a partial isometric view of a printhead according to the present invention.

In the present invention, a plurality of ink jet printheads are fabricated by methods known in the art such as U.S. Pat. No. 4,789,425 to Drake et al. and U.S. Pat. No. 4,601,777 to Hawkins et al., both of which are incorporated herein by reference. As shown in FIG. 1, there is a partial isometric view of a roofshooter type printhead 10 with arrows 12,14 depicting trajectories of droplets 16A,16B from low resolution nozzles 18 and high resolution nozzles 20, respectively. The printhead comprises a structural member 22 on which nozzles 18 and 20 are formed, which is attached to a heater plate 24. The heater plate 24 contains an etched opening which when mated to the structural member 22 forms an ink reservoir 26. Electrode terminals 28 and common return terminals 30 extend beyond structural member 22 and lie at the edge of surface 32 of heater plate 24. The heater plate will be discussed in greater detail later and can be fabricated as disclosed in U.S. Pat. No. 4,789,425 to Drake et al.

Figure 2:
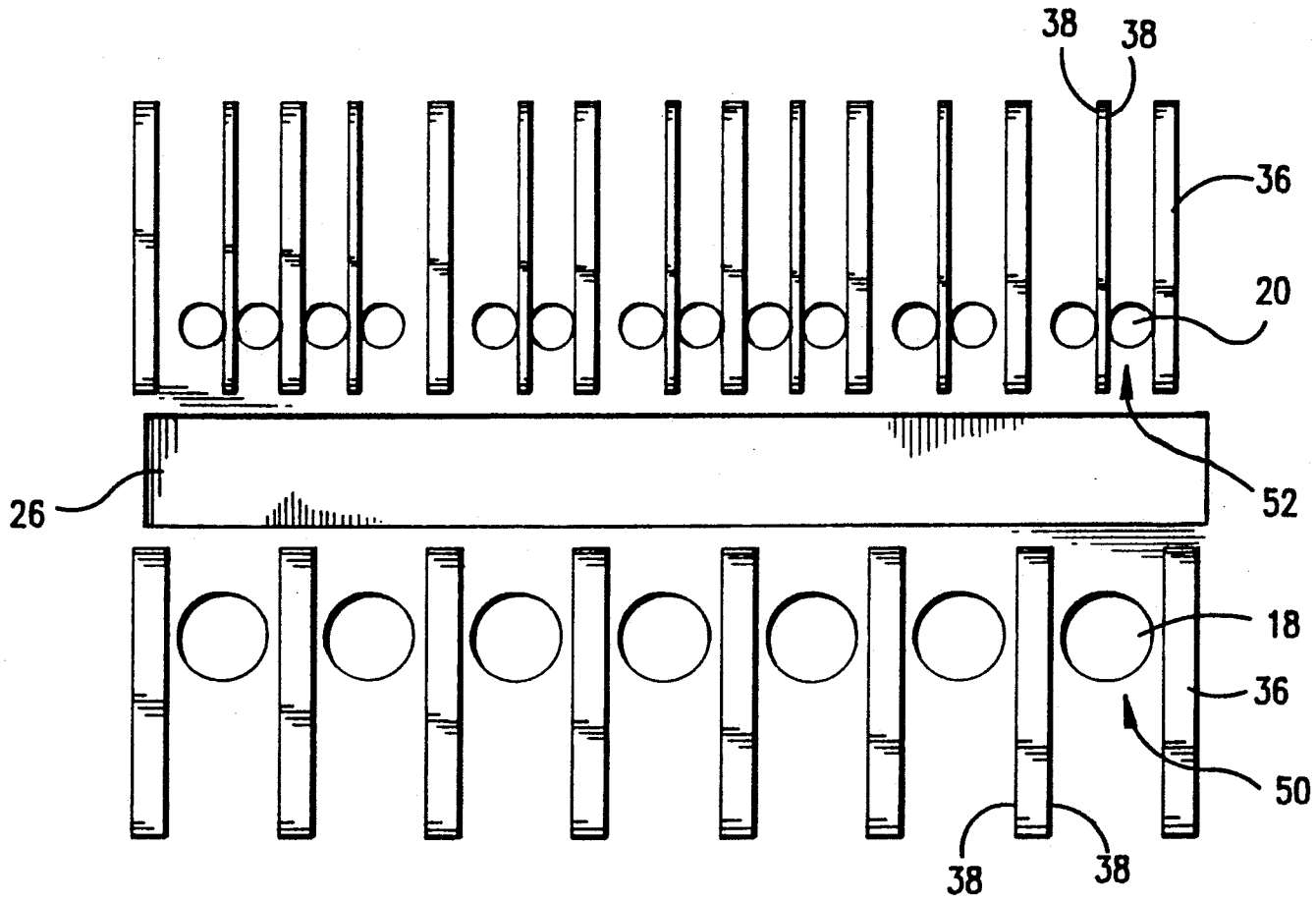
FIG. 2 is a partial sectional view of the printhead of FIG. 1 taken along section 1—1.
Figure 3:
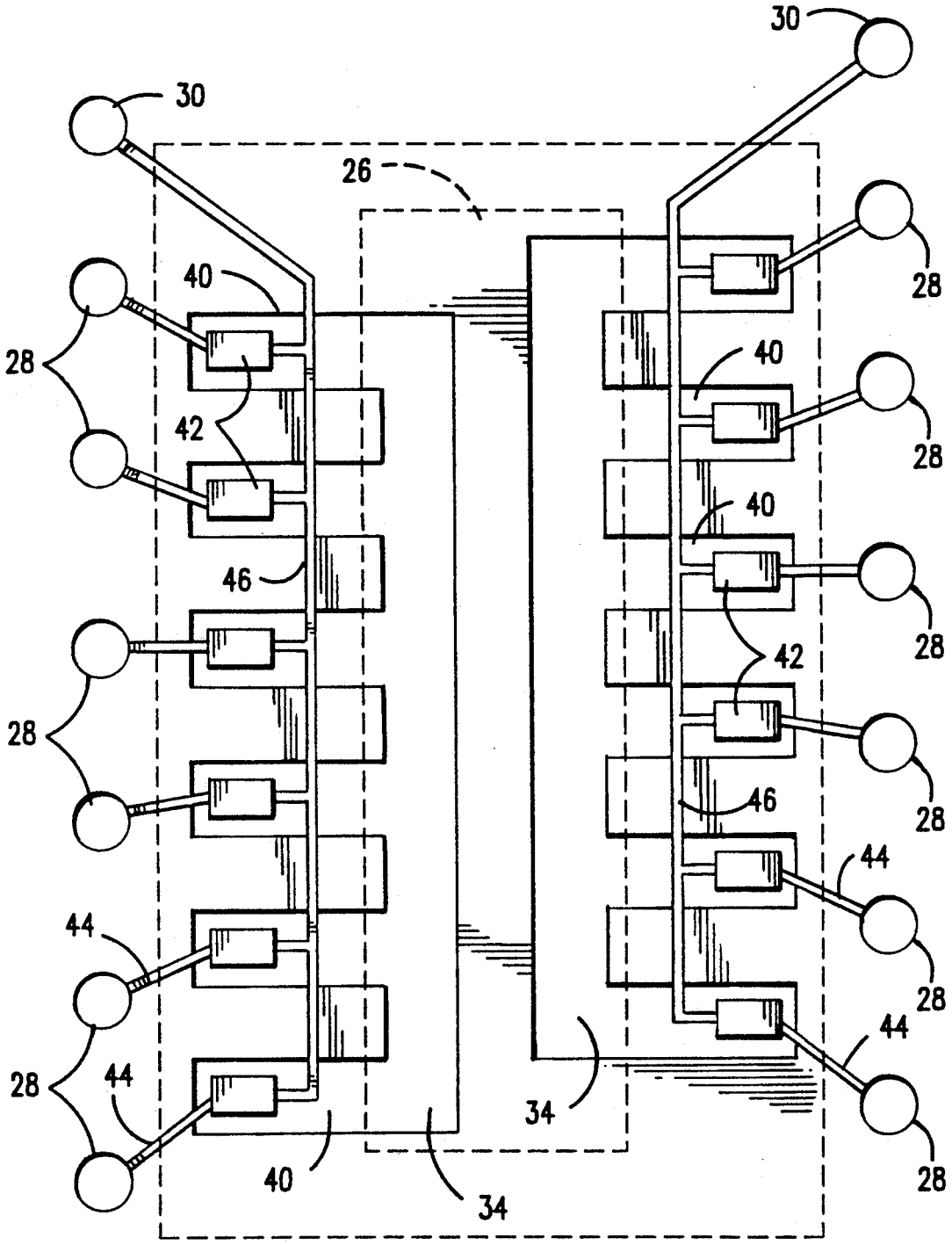
FIG. 3 is a partial sectional view of the printhead of FIG. 1 taken along section 2—2.

In FIG. 2, a partial view of structural member 22 is shown from the bottom as seen along line 1—1 of FIG. 1, wherein a top of ink reservoir 26 is shown together with a plurality of parallel walls 36. Each wall has a substantially planar surface 3B on opposite sides thereof, so that pairs of confronting wall surfaces have located therebetween an associated nozzle (18 or 20) and a heating element 42 below the nozzle (shown in FIG. 3). Each of two nozzle arrays are located on opposite sides of ink reservoir 26. The two arrays may be aligned perpendicular to each other as shown or may be offset or staggered as shown in FIG. 3. On one side of the reservoir 26 are nozzles 18 which form low resolution array 50. On the other side of reservoir 26 are nozzles 20 which form high resolution array 52. It is understood that this depicts a simplified representation of the present invention and that an actual printhead would preferably have 150 nozzles per inch for the low resolution array and 300 nozzles per inch for the high resolution array.

FIG. 3 shows an enlarged, simplified schematic plan of the printhead 10 as seen along view line 2—2, showing only a portion of the actual number of components to simplify the description. It is understood that a true view of this printhead would show a heating element and associated ink channel density of about 150 per inch for the low resolution array and about 300 per inch for the high resolution array. A plurality of bubble generating heating elements 42 are connected to electrode terminals 28 through addressing electrodes 44 and are connected together through common return 46 terminating at a common return terminal 30. The inside dashed line shows the positioning of the ink reservoir 26 and the outside dashed line shows the perimeter of the structural member 22. The spaces between the opposing walls 36 define ink channels 40 which provide ink replenishing flow paths from the reservoir 26 to the nozzles 18,20. The heating elements 42 are in fluid communication with ink in the ink reservoir through ink channels 40. The ink channels are joined at one end thereof by manifold cavities 34.

Figure 4:
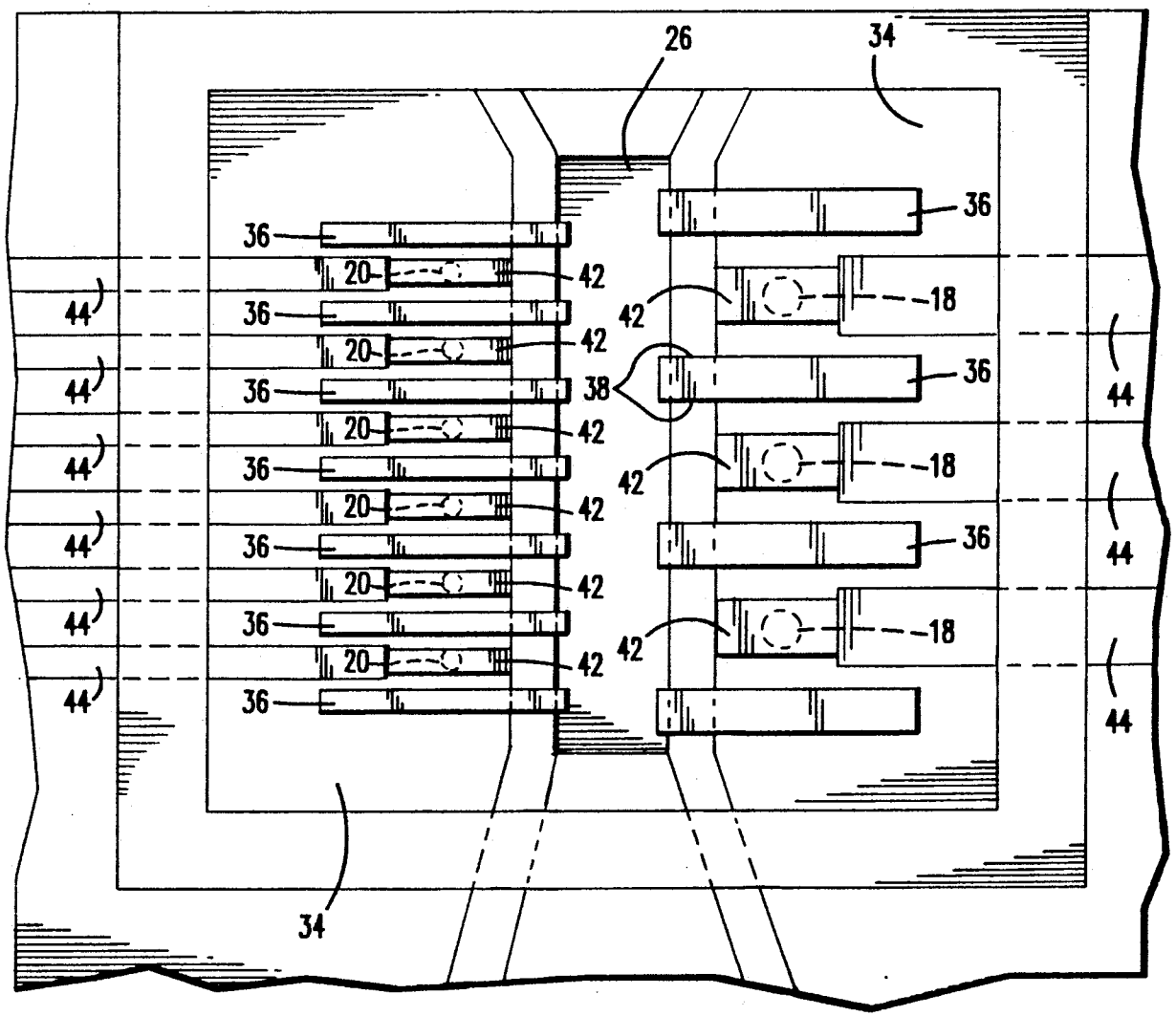
FIG. 4 is a partial sectional view of the printhead FIG. 1 taken along section 3—3.

FIG. 4 shows a partial schematic view of the printhead as seen along line 3—3 of FIG. 1. Ink enters the ink reservoir 26 and fills the cavities 34 and ink channels 40 defined by the wall surfaces 38 of walls 36. The nozzles 18,20 above the heating elements 42 are depicted in dashed lines, since they cannot be seen in FIG. 4. The depth of the cavity 34 is between 1 to 2 mils (25 to 50 micrometers) so that the ink reservoir 26 holds a predetermined quantity of ink. Only a small portion of length of each passivating addressing electrode 44 is exposed to the ink in cavity 34 to reduce the effect of pinholes in that portion of passivation.

Figure 5:
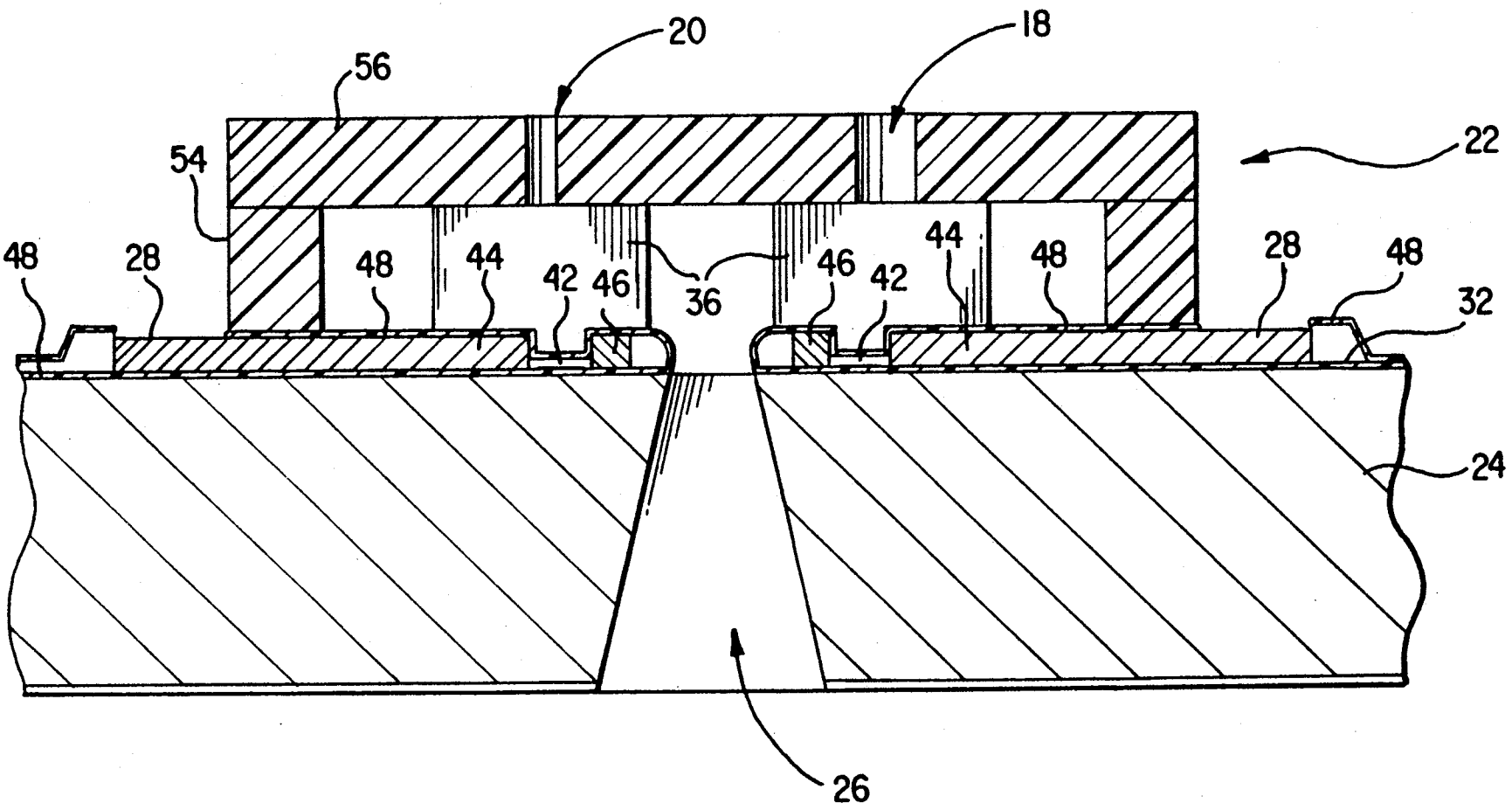
FIG. 5 is a partial sectional view of the printhead of FIG. 1 taken along section 4—4.

FIG. 5 shows a partial view of the printhead of FIG. 1 taken along section 4—4. In this view there is shown heater plate 24 having ink reservoir 26 contained therein. The printhead can be fabricated such as by the methods described in U.S. Pat. No. 4,601,777 to Hawkins et al. and 4,789,425 to Drake et al. A plurality of bubble generating elements 42, their addressing electrodes 44, and common return 46 can be patterned onto a masking film on surface 32 of the heater plate 24. The common return and the addressing electrodes are aluminum leads deposited onto the plate 24. Common return terminals 30 and electrode terminals 28 are positioned at predetermined locations to allow clearance for wire bonding to a source of current pulses, as disclosed in U.S. Pat. No. 4,601,777. The common return and the addressing electrodes are deposited to a thickness of 0.5 to 3.0 microns. A one micron thick phosphorous doped chemical vapor deposition silicon dioxide film 48 is deposited over the entire plurality of heating elements and addressing electrodes. Optionally, a Tantalum (Ta) layer may be deposited to a thickness of about 1 micron on the heating elements for added protection thereof against cavitational forces generated by collapsing ink vapor bubbles during printhead operation.

After the heater plate having heating elements 42 is fabricated, the structural member is formed and bonded to form the printhead by the following process. A layer of patternable material in dry form is applied to the etched and completed heater plate 24. Suitable materials are those which can be delineated by photosensitization, exposure and development or by wet or dry etching through a pattern mask. For example, a photosensitive layer such as Vacrel Soldermask, sold by Dupont Chemical Co., could be laminated to heater plate 24, followed by UV exposure, development and cure to form side walls 54 and 36 of structural member 22. Another dry film photoresist is placed over the patternable material (now sides 54) and aligned and developed to form a roof 56 of structural member 22, the roof 56 having low resolution nozzle array 50 comprising nozzles 18 and high resolution array 52 comprising nozzles 20 formed therein. Alternatively, roof 56 could be fabricated by electroforming and then adhesively bonding the electroform to the top of the walls 54 and 36.

A printhead according to the present invention fabricated as previously described can be used on a thermal ink jet printer to provide multi-purpose printing capabilities with a single printhead. Through suitable control of the activation of the heating elements, the printhead may operate using one of the two arrays of nozzles and associated heating elements to provide either a low resolution print such as for draft printing or a high resolution print such as for letter quality printing or for grey scale reproduction. There are at least two methods of array selection: 1) a switch that allows the user to select draft mode or letter quality/graphics mode; and 2) an image bit map algorithm that can choose to fire either the high resolution nozzles, the low resolution nozzles or appropriate combinations of both. It is worthwhile to note that current commercial printers that offer draft or letter quality modes do so by printing fewer pixels in the draft mode. While this increases the printing speed of the draft mode, the printed pixels are widely spaced so that the print quality is objectionable. The proposed dual resolution ink jet printhead does not suffer this problem, since the pixels of the low resolution overlap. This allows precise multiple resolutions to be obtained easily without requiring additional printheads or complicated software or control to determine or change droplet size of ink emitted from a standard printhead to reproduce data in different resolutions.

Preferably, the printhead nozzle arrays 50 and 52 have a resolution ratio of between 1.5 and 5, and more preferably a ratio of 2. The printhead according to the present invention preferably provides a low resolution nozzle array having a resolution of between 50 DPI and 300 DPI, and more preferably 150 DPI and a high resolution nozzle array having a resolution of between 200 DPI and 800 DPI, and more preferably 300 DPI.

The invention has been described with reference to its preferred embodiments which are intended to be illustrative and not limiting. Various changes can be made without departing from the spirit and scope of the invention as described in the appended claims.

What is claimed is:

1. A roofshooter type thermal ink jet printhead for use in a drop on demand ink jet printing device, capable of operating in a draft quality mode and a letter quality mode, the roofshooter printhead comprising:

a heater plate comprising an elongated ink fill hole and two linear arrays of heating elements, each of said two linear arrays of heating elements being spaced a distance from said ink fill hole and being on opposite sides of said ink fill hole; and a fluid directing structural member attached to said heater plate comprising at least one recessed cavity, a plurality of parallel walls within said at least one recessed cavity which define individual ink channels for directing ink from said ink fill hole, and two linear arrays of nozzles corresponding to said linear arrays of heating elements and being located directly above said heating elements to define two parallel spaced longitudinal nozzle planes, each nozzle communicating with a corresponding ink channel and printing ink in a same color, wherein said two linear arrays of nozzles have unequal sized nozzle diameters to define a high resolution array and a low resolution array, said high resolution array having a greater number of nozzles per unit length than said low resolution array, said low resolution array providing the draft quality mode and said high resolution array providing the letter quality mode.

2. The roofshooter printhead of claim 1, wherein said two arrays of nozzles are mutually aligned with one another perpendicular to said nozzle planes.

3. The roofshooter printhead of claim 1, wherein said two arrays of nozzles are staggered relative to one another perpendicular to said nozzle planes.

4. The roofshooter printhead of claim 1, wherein said low resolution array of nozzles has a resolution of about 150 nozzles per inch.

5. The roofshooter printhead of claim 1, wherein said high resolution array of nozzles has a resolution of about 300 nozzles per inch.

6. The roofshooter printhead of claim 1, wherein said low and high resolution arrays have a resolution ratio to one another of substantially 2.

7. The roofshooter printhead of claim 1, wherein said low resolution array of nozzles is activated and said high resolution array of nozzles is inactivated in a draft quality mode.

8. The roofshooter printhead of claim 1, wherein said high resolution array of nozzles is activated and said low resolution array of nozzles is inactivated in a letter quality mode.

9. The roofshooter printhead of claim 1, wherein said low and high resolution arrays of nozzles are activated and a combination of both arrays are utilized upon detection of pictorial information.

10. The roofshooter of claim 9, wherein said pictorial information is a grey scale image.

11. The roofshooter printhead of claim 1, wherein said ink jet printing device comprises a plurality of said roofshooter printheads, each containing a different color of ink to provide a color printing device.

12. A printhead for a printer comprising:

a heater substrate having an ink feed slot and an array of heating elements on each side of said ink feed slot, each array of heating elements being selectively actuatable, and a fluid directing structural member having an internal cavity communicating with said ink feed slot, a plurality of parallel walls defined in said internal cavity to define two arrays of ink channels, each corresponding to one of the arrays of heating elements, each ink channel being located above a corresponding heating element and communicating with said ink feed slot, and two spaced arrays of printhead nozzles each corresponding to one of the arrays of ink channels with each nozzle communicating with a corresponding ink channel to produce a same printed color, a first one of said arrays of printhead nozzles having a greater number of nozzles per unit length and a smaller nozzle diameter than a second one of said arrays of printhead nozzles, to provide the printhead with multiple resolution modes.

13. The printhead of claim 12, wherein said second one of said arrays of printhead nozzles is a low resolution nozzle array and the first one of said arrays of printhead nozzles is a high resolution array.

14. The printhead of claim 13, wherein an array of heating elements corresponding to said low resolution nozzle array is actuated in a draft quality mode of said multiple resolution modes.

15. The printhead of claim 13, wherein an array of heating elements corresponding to said high resolution nozzle array is activated in a letter quality mode of said multiple resolution modes.

16. The printhead of claim 13, wherein the arrays of heating elements corresponding to said high and low resolution arrays are activated in a gray scale image mode of said multiple resolution modes.

17. The printhead of claim 13, wherein one array of ink channels and its corresponding array of printhead nozzles are aligned with the other array of ink channels and its corresponding array of printhead nozzles.

18. The printhead of claim 13, where one array of ink channels and its corresponding array of printhead nozzles are arranged in a staggered relationship with the other array of ink channels and its corresponding array of printhead nozzles.

19. A method of carrying printing resolution of a printhead comprising the steps of:

bonding a heater substrate having an architecture including a first and second arrays of heating elements on opposite sides of an ink feed slot to a fluid directing structural member having first and second arrays of printhead nozzles on opposite sides of said ink feed slot to form a printhead in which the first and second arrays of heating elements project ink through said first and second arrays of printhead nozzles, respectively; and varying a nozzle diameter, number of nozzles per unit length, and heating element area of said first array of printhead nozzles and heating elements from a nozzle diameter, number of nozzles per unit length, and heating element area of said second array of printhead nozzles and heating elements to provide said printhead with multiple resolution modes.

20. The method of claim 19, further comprising the step of selectively activating said first and second arrays of heating elements and printhead nozzles to provide one of a low resolution mode wherein one of the first and second arrays is activated, a high resolution mode wherein the other of said first and second arrays is activated, and an enhanced grey scale mode wherein both said first and second arrays are activated.

* * * * *